United States Patent [19]

Ohkata

[11] 4,444,721

[45] Apr. 24, 1984

[54] RESILIENT SUPPORTING MEMBER FOR EXHAUST GAS CATALYTIC CONVERTER

[75] Inventor: Ichizo Ohkata, Yokohama, Japan

[73] Assignee: Kato Hatsujo Kaisha, Ltd., Yokohama, Japan

[21] Appl. No.: 362,851

[22] Filed: Mar. 29, 1982

[30] Foreign Application Priority Data

Nov. 24, 1981 [JP] Japan ..... 56-188205

[51] Int. Cl.[3] ..... F01N 3/10

[52] U.S. Cl. ..... 422/179; 60/299; 248/562; 422/180

[58] Field of Search ..... 422/177, 179, 180; 29/157 R, 419 R; 60/299, 301, 302; 138/108; 248/562, 634; 55/DIG. 30

[56] References Cited

U.S. PATENT DOCUMENTS

| | | | |
|---|---|---|---|
| 3,854,888 | 12/1974 | Frietzsche et al. | 422/179 X |
| 3,948,611 | 4/1976 | Stawsky | 60/299 X |
| 3,966,419 | 6/1976 | Bloomfield | 422/179 |
| 4,142,864 | 3/1979 | Rosynsky et al. | 422/179 |
| 4,143,117 | 3/1979 | Gaysert | 422/179 |
| 4,161,509 | 7/1979 | Nowak | 422/179 |
| 4,163,041 | 7/1979 | Gaysert | 248/562 X |
| 4,203,949 | 5/1980 | Mase et al. | 422/179 |
| 4,353,873 | 10/1982 | Noritake et al. | 422/180 X |
| 4,362,700 | 12/1982 | Hayashi et al. | 422/179 |

FOREIGN PATENT DOCUMENTS

| | | | |
|---|---|---|---|
| 2525660 | 12/1975 | Fed. Rep. of Germany | 422/179 |

*Primary Examiner*—Richard L. Chiesa

*Attorney, Agent, or Firm*—Schwartz, Jeffery, Schwaab, Mack, Blumenthal & Koch

[57] ABSTRACT

A resilient supporting member for an exhaust gas catalytic converter which has a thin plate of ceramic fiber, an edgewise peripheral base formed by pressing a laminate formed by folding a cylindrical unit of knitted or looped fabric made of stainless steel fine wires and folding the thin plate, and an erected peripheral end erected from the base in an L shape in section. Thus, the resilient supporting member can effectively prevent the exhaust gas from entering into the air gap passage in the catalytic converter.

9 Claims, 13 Drawing Figures

RESILIENT SUPPORTING MEMBER FOR EXHAUST GAS CATALYTIC CONVERTER

BACKGROUND OF THE INVENTION

This invention relates to a catalytic converter used to purify the exhaust gas of a vehicle and, more particularly, to a resilient supporting member for elastically supporting a ceramic honeycomb unit as a constituent of the catalytic converter.

A conventional catalytic converter, generally designated by reference numeral 1 in FIG. 1, is divided into upper and lower sections at the centerline A—A known per se, and has a casing 2 made of refractory stainless steel material, a ceramic honeycomb unit 6 contained within the casing 2 for purifying exhaust gas, and resilient supporting members 5, 5 for supporting the honeycomb unit 6 at the inner peripheral wall 3 of the casing 2 at both the cylindrical ends. Thus, an air gap passage 4 is formed between the ceramic honeycombs unit 6 and the inner peripheral wall 3 of the casing 2 between the supporting members 5 and 5.

The exhaust gas from an internal combustion engine in a vehicle is fed in the catalytic converter 1 from one tubular end 2' of the casing 2, then passed through the known honeycomb pores (not shown) formed in the interior of the honeycomb unit 6 to be purified in contact with the catalyst coated on the surface of the pores, and eventually fed out of the other tubular end 2''.

Since the catalytic converter 1 is thus constructed as described above, the exhaust gas thus inflowed is not entirely passed through the interior of the ceramic honeycomb unit 6, but a part of the exhaust gas is introduced from the tubular end 2' into one resilient supporting member 5, through the air gap passage 4, then via the other resilient supporting member 5, and exhausted from the other tubular end 2'' as the exhaust gas without being purified therethrough.

SUMMARY OF THE INVENTION

Accordingly, a primary object of this invention is to provide a resilient supporting member for an exhaust gas catalytic converter which can eliminate all the aforementioned disadvantages and drawbacks of the conventional catalytic converter due to the non gas permeability of the resilient supporting member in the conventional catalytic converter and which does not discharge exhaust gas not purified from the catalytic converter by disposing a thin plate-shaped gas shielding material made of ceramic fiber newly prepared of predetermined shape at a predetermined position as one constituent element of the resilient supporting member in the catalytic converter.

Another object of this invention is to provide a resilient supporting member for an exhaust gas catalytic converter which can resiliently hold a ceramic honeycomb unit in a casing with equivalent elasticity to that of the conventional catalytic converter by forming the thin plate of novel ceramic fiber.

Still another object of this invention is to provide a resilient supporting member for an exhaust gas catalytic converter which can effectively prevent exhaust gas from entering into an air gap passage in the catalytic converter by interposing a U-shaped thin plate between a ceramic honeycomb unit and a casing in the catalytic converter.

Still another object of this invention is to provide a resilient supporting member for an exhaust gas catalytic converter which can remarkably purify the exhaust gas from an internal combustion engine.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

Figure 1:
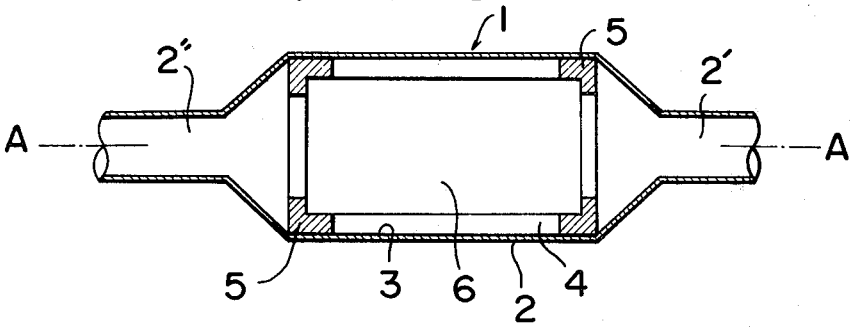
PRIOR ART FIG. 1
FIG. 1 is a longitudinal side sectional view of the conventional exhaust gas catalytic converter.
Figure 2:
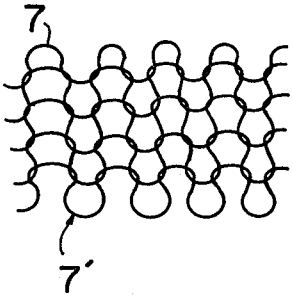
FIG. 2 is a structural view of the knitted or looped fabric employed to form a thin plate made of ceramic fiber newly prepared according to the present invention for the exhaust gas catalytic converter.
Figure 3:
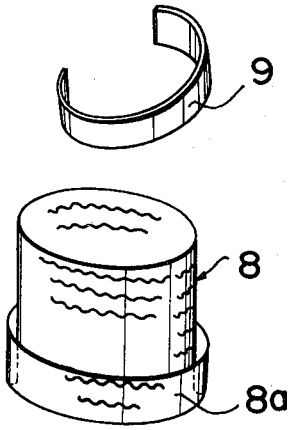
FIG. 3 is a perspective view showing a thin plate as one constituent element of the resilient supporting member constructed according to the present invention together with a cylindrical looped fabric unit for the exhaust gas catalytic converter.

Reference is now made to the drawings, particularly to FIGS. 2 and 3 showing one preferred embodiment of the resilient supporting member employed in the exhaust gas catalytic converter constructed according to the present invention, wherein like reference numerals designate the same or equivalent components and parts in the following views.

A knitted or looped fabric 7' is knitted with metallic fine wires 7 made of stainless steel by an ordinary knitting machine, and a seamless looped fabric cylindrical material is then formed of the knitted or looped fabric 7'.

The seamless looped fabric cylindrical material thus formed is cut in a predetermined length to form a cylindrical looped fabric unit 8 shown in FIG. 3, and a thin plate 9 formed in strip shape is separately prepared by ceramic fiber as shown in FIG. 3.

The thin plate 9 is so formed as to have substantially equal length to the diameter of the outer periphery of the cylindrical looped fabric unit 8 and to also have a width substantially smaller than of the length of the cylindrical unit 8 in such a manner that the thin plate 9 may be conveniently wound on the cylindrical unit 8, as will be described in greater detail.

The resilient supporting member of the present invention will be formed subsequently by the cylindrical looped fabric unit 8 and the thin plate 9 by the steps as below.

Figure 4A:
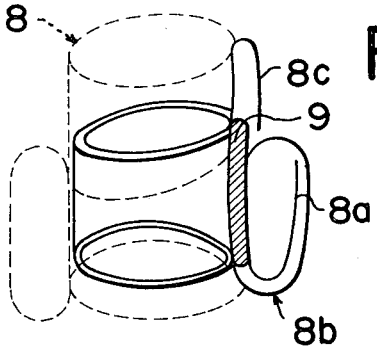
FIGS. 4(*a*) through 4(*c*) are schematic sectional views showing the steps of winding the thin plate on the cylindrical looped fabric unit to form an annularly bent laminate to be employed in the exhaust gas catalytic converter of the present invention.
Figure 4B:
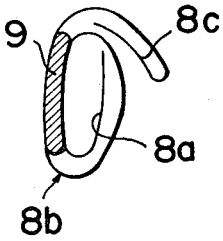
Figure 4C:
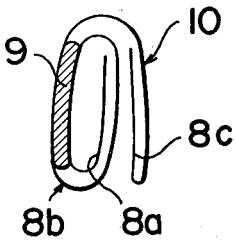
Figure 5A:
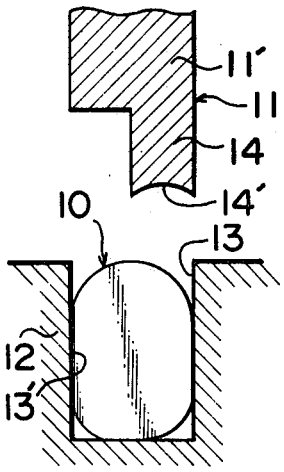
FIGS. 5(*a*) through 5(*c*) and 5(*a'*) through 5(*c'*) are schematic sectional views of a press mold illustrating the steps of pressing the annularly bent laminate and schematic sectional views of the annularly bent laminated correspondingly deformed by the press mold in the respective steps according to the present invention.
Figure 5B:
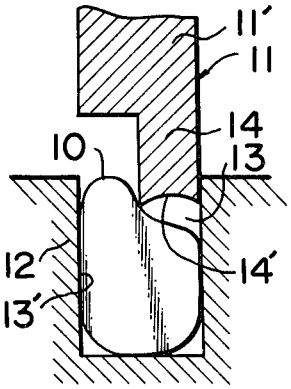
Figure 5C:
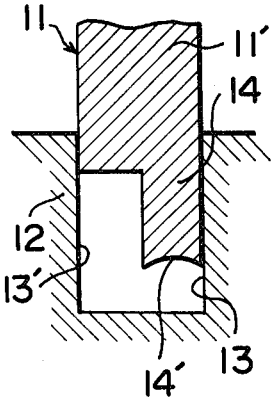
Figure 5A:
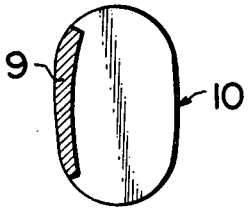
Figure 5B:
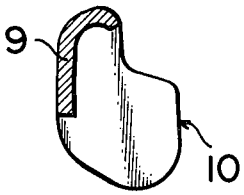
Figure 5C:
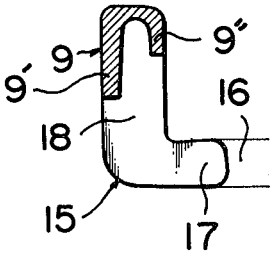

As evidently shown in FIG. 3, one end 8*a* of the cylindrical looped fiber unit 8 is directed outwardly, then folded substantially in the same width as the thin plate 9, and further so folded repeatedly as to wind it as shown in FIG. 4(*a*), thereby forming a bent superposed part 8*b* as shown.

Then, the thin plate 9 is inserted into the inside of the bent superposed part 8*b* of the cylindrical unit 8 as shown in FIG. 4(*a*) by the shaded zone. Thereafter, the other end 8*c* of the cylindrical looped fabric unit 8 is also outwardly folded as shown in FIG. 4(*a*) by a solid line, further folded repeatedly from the inside upper part onto the outside thereof outwardly as shown in FIG. 4(*b*), and thus a bent superposed part 8*c* is laminated on the outside of the bent superposed part 8*b* as shown in FIG. 4(*c*), thereby forming an annularly bent laminate 10 as shown.

The annularly bent laminate 10 will be subsequently pressed as below as shown in FIGS. 5(*a*) through 5(*c*) by the steps as below.

These steps employ a male mold 11 and a female mold 12 having a holding cavity 13. As shown in FIG. 5(*a*), the annularly bent laminate 10 thus formed is inserted into the holding cavity 13 of the female mold 12 in such a manner that the thin plate 9 is brought into contact with the inner peripheral wall 13' of the holding cavity 13 at the outside as designated in FIG. 5(*a'*) .

Subsequently, the laminate 10 is pressed by the male mold 11 as shown in FIG. 5(*b*), on which a lower projection 14 is protruded downwardly from the lower inner circumference of the base 11' thereof and a recessed end face 14 is formed on the bottom surface of the projection 14 thereof. When the laminate 10 inserted into the holding cavity 13 of the mold 12 is pressed by the male mold 11, the projection 14 of the mold 11 is protruded into the inner peripheral side of the holding cavity 13 at the opposite side to the thin plate 9 of the laminate 10.

As the projection 14 of the mold 11 is protruded into the holding cavity 13 of the mold 12, the laminate 10 is pressed and deformed as designated in FIG. 5(*b'*). Thus, the mold 11 is pressed to its final stage as shown in FIG. 5(*c*), and the laminate 10 is thus deformed into an L shape in cross section as designated in FIG. 5(*c'*). The mold 11 is so pressed into the holding cavity 13 of the mold 12 as to deform the thin plate 9 of the laminate 10 gradually in a U shape. A resilient supporting member 15 thus obtained is formed with an edgewise peripheral base 17 forming a port 16 and with an erected peripheral end 18 substantially perpendicularly erected from the base 17 together with the thin plate 9 deformed in U shape in cross section at the end of the peripheral end 18 of the resilient supporting member 15.

An exhaust gas catalytic converter 1 is then associated with the resilient supporting member 15 thus obtained as below.

Figure 6:
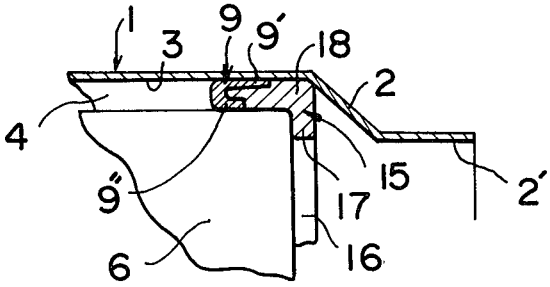
FIG. 6 is a partial sectional view of the U-shaped thin plate contained in pressed state between the inner peripheral wall of the casing and the outer peripheral surface of the ceramic honeycomb unit of the catalytic converter of the present invention.

As shown in FIG. 6, the resilient supporting member 15 thus formed is initially engaged with each of both the circumferential end corner of the ceramic honeycomb unit 6, and upper and lower casings 2 are covered thereon. Thus, the U-shaped thin plate 9 of the resilient supporting member 15 is contained at both the peripheral legs 9' and 9'' thereof under pressed state between the inner peripheral wall 3 of each of the casings 3 and the outer peripheral surface of the ceramic honeycomb unit 6' thereby preventing exhaust gas tending to enter into the air gap passage 4 from the tubular end 2 of the casing 2 from entering thereinto by the thin plate 9 of the resilient supporting member 15.

It should be appreciated from the foregoing description that since the resilient supporting member of the exhaust gas catalytic converter of the present invention is thus constructed to comprise an edgewise peripheral base formed by pressing an annularly bent laminate formed by folding a cylindrical looped fabric unit formed by knitting metallic fine wires and winding a thin plate of ceramic fiber, forming a port, an erected peripheral end erected from the peripheral base in an L-shape in cross section, and said thin plate formed in U shape in cross section and opened toward the base at the end of the peripheral end, the thin plate made of ceramic fiber can resiliently hold the ceramic honeycomb unit with the equivalent elasticity to the conventional one and the U-shaped thin plate can prevent the exhaust gas from entering into the air gap passage between the ceramic honeycomb unit and the casings, thereby remarkably improving the exhaust gas purifying function of the catalytic converter.

What is claimed is:

1. A resilient supporting member for an exhaust gas catalytic converter, comprising:

a thin plate of ceramic fiber, an edgewise peripheral base formed by pressing an annularly bent laminate formed by folding a cylindrical looped fabric unit formed from knitted metallic fine wires and winding said thin plate to form a port, and an erected peripheral end erected from said peripheral base having an L shaped cross section, said thin plate having a U shaped cross section and being open toward said peripheral base at the end of said peripheral end.

2. The resilient supporting member according to claim 1, wherein said annularly bent laminate is formed by directing one end of the cylindrical looped fiber unit outwardly, folding the one end of the cylindrical unit a predetermined number of times to form a bent superposed part, inserting said thin plate into the inside of the bent superposed part of the cylindrical unit, outwardly folding the other end of the cylindrical looped fabric unit, further folding the other end of the cylindrical unit from the inside upper part onto the outside thereof outwardly and laminating the bent superposed part on the outside of the bent superposed part thereof.

3. The resilient supporting member according to claim 1, wherein said annularly bent laminate is so inserted into the holding cavity of a male press mold that said thin plate is disposed at the inner peripheral wall of the holding cavity at the outside and pressed by a projection protruding from the base of the male mold to the outer peripheral side of the holding cavity thereof.

4. A resilient supporting member for an exhaust gas catalytic converter, comprising:

a thin plate of ceramic fiber; and a looped fabric unit of knitted metallic fine wires folded about said thin plate, the supporting member having a base and a leg section in an L-shaped cross section, with said thin plate forming a U-shape at the end of said leg section opposite said base and being open toward said base.

5. A resilient supporting member as claimed in claim 4, wherein said metallic fine wires comprise stainless steel.

6. A resilient supporting member as claimed in claim 4, wherein said thin plate is gas impermeable.

7. A resilient supporting member as claimed in claim 4, produced by a method comprising the steps of:

providing a knitted fabric of metallic fine wires;

introducing a thin plate of ceramic fiber to said knitted fabric;

folding said knitted fabric about said thin plate to form an annularly bent laminate; and forming said annularly bent laminate into the shape of an L having a base and a leg section, wherein said thin plate is formed into a U-shaped position in the end of said leg section opposite said base and opening towards said base.

8. A resilient supporting member as claimed in claim 7, wherein said forming step comprises placing said annularly bent laminate into a female mold and pressing said laminate in said female mold with a male mold comprising a projection for forming said laminate into said L-shape.

9. A catalytic converter unit comprising a catalytic converter, and at least two of said resilient supporting members as claimed in claim 4, wherein said supporting members are positioned at the end corners of said catalytic converter near the exhaust gas exit of the unit having said base section substantially perpendicular with the longitudinal axis of said unit and said leg section substantially parallel to said axis, said U-shaped thin plate being at the contacting edge of the supporting member with the exhaust gas.

* * * * *